US005396830A

United States Patent [19]

Kornblith et al.

[11] Patent Number: 5,396,830

[45] Date of Patent: Mar. 14, 1995

[54] ORTHOGONAL LINE DEPLOYMENT DEVICE

[75] Inventors: Jeffrey S. Kornblith, Mystic, Conn.; Stephen Soszynski, Hingham, Mass.

[73] Assignee: The United States of America as represented by the Secretary of the Navy, Washington, D.C.

[21] Appl. No.: 266,812

[22] Filed: Jun. 17, 1994

[51] Int. Cl.[6] ..... F41B 11/06

[52] U.S. Cl. ..... 89/1.34; 89/1.7; 124/57; 124/59; 102/504

[58] Field of Search ..... 89/1.7, 1.34, 1.701, 89/1.702, ; 124/59, 57; 102/504; 441/85

[56] References Cited

U.S. PATENT DOCUMENTS

| | | | |
|---|---|---|---|
| 433,674 | 8/1890 | D'Arcy-Irvine | 89/3.14 |
| 3,382,859 | 10/1965 | Myers | 124/11 |
| 3,575,083 | 4/1971 | Hudick et al. | 89/1 |
| 3,669,087 | 6/1972 | Hamrick et al. | 124/11 |
| 4,559,737 | 12/1985 | Washington | 43/59 |

*Primary Examiner*—Charles T. Jordan
*Assistant Examiner*—Christopher Keith Montgomery
*Attorney, Agent, or Firm*—Michael J. McGowan; Prithvi C. Lall; Michael F. Oglo

[57] ABSTRACT

A gas-propelled line deployment device is operable for orthogonally deploying two antenna lines to a distance of greater than one hundred feet. The device includes first, second and third tubes, closed at one end and open at one end, the first and second tubes being arranged perpendicular to each other and the third tube being arranged along the resulting vector of the axes of the perpendicular tubes. The first and second tubes have wire-carrying projectiles received therein and the third tube has a recoil piston received therein, said projectiles and piston making a gas tight seal with their respective tube. The recoil piston has a larger cross-sectional area than each of the first and second wire-carrying projectiles. The device further includes a retainer mechanism which is operable for retaining the wire-carrying projectiles and the recoil piston within their respective tubes until a predetermined gas pressure is achieved. The retainer mechanism is further operable for automatically, and simultaneously releasing the wire-carrying projectiles and the recoil piston when the predetermined gas pressure is achieved within the closed ended tubes. When the wire-carrying projectiles are launched, the recoil piston produces an equal and opposite reaction force to the wire-carrying projectiles so that the device is essentially recoilless.

12 Claims, 4 Drawing Sheets

ORTHOGONAL LINE DEPLOYMENT DEVICE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The instant invention relates to means for deploying an antenna line or wire over the ground, and more particularly to an orthogonal antenna line deployment device.

2. Description of the Prior Art

Means for deploying wires or lines along a particular path, or over the ground have heretofore been known in the art. In this regard, the U.S. patents to Myers U.S. Pat. No. 3,382,859; Hudiek et. al. U.S. Pat. No. 3,575,083; Hamrick U.S. Pat. No. 3,669,087; Alderson U.S. Pat. No. 3,780,720; Barret et. al. U.S. Pat. No. 4,653,379; and Pinson U.S. Pat. No. 4,770,370 are illustrative of such devices.

Means for simultaneously deploying two projectiles in different directions have also been known in the art. In this regard, the U.S. patents to Grandy et. al. U.S. Pat. No. 3,633,509 and Washington U.S. Pat. No. 4,559,737 represent the closest prior art to the subject invention of which the applicant is aware.

The patent to Grandy discloses a recoilless flare launching apparatus for a helicopter which simultaneously launches two flares in outwardly opposing directions. The opposing propulsion forces cancel each other out thereby preventing any recoil forces from affecting the helicopter.

The patent to Washington discloses a gun for launching two tethered projectiles at acute angles. The gun includes a Y-shaped barrel and the projectiles are received in the divergent portions of the barrel. The tether or string attaching the projectiles is slidably received in a slot extending along the inside of both divergent barrels. The gun is operative for simultaneously launching the tethered projectiles wherein they are operative for entangling the legs of a fleeing person or animal.

SUMMARY OF THE INVENTION

The instant invention provides an orthogonal line deployment device for orthogonally deploying two antenna lines.

Briefly, the orthogonal line deployment device of the instant invention comprises first and second closed-ended tubes which are arranged perpendicular to each other and a third tube which is arranged along a resultant vector of the axes of the first and second tubes. The first and second tubes have wire-carrying projectiles slidably received therein, and the third tube has a recoil piston slidably received therein. The recoil piston has a cross-sectional area 1.414 times larger than each of the wire-carrying projectiles. The device utilizes a pressurized gas canister for propulsion of the wire-carrying projectiles and the recoil piston, and the gas canister is operable for selectively simultaneously introducing a pressurized flow of gas into all three tubes. The device further includes a retaining mechanism for retaining the wire-carrying projectiles and the recoil piston in their respective tubes until a predetermined equal gas pressure is achieved in all three tubes. The retaining mechanism is operable for simultaneously releasing the wire-carrying projectiles and the recoil piston when the predetermined gas pressure is achieved. When the wire-carrying projectiles and the piston are released, the wire-carrying projectiles orthogonally deploy the two antenna lines as they travel through the air, and the recoil piston produces an equal and opposite reaction force to the wire-carrying projectiles, resulting in a device which is substantially recoilless.

Accordingly, it is an object of the instant invention to provide a line deployment system for simultaneously deploying two antenna lines.

It is another object to provide an orthogonal line deployment device for orthogonally deploying two antenna lines.

It is still another object to provide an orthogonal line deployment device which is substantially recoilless.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
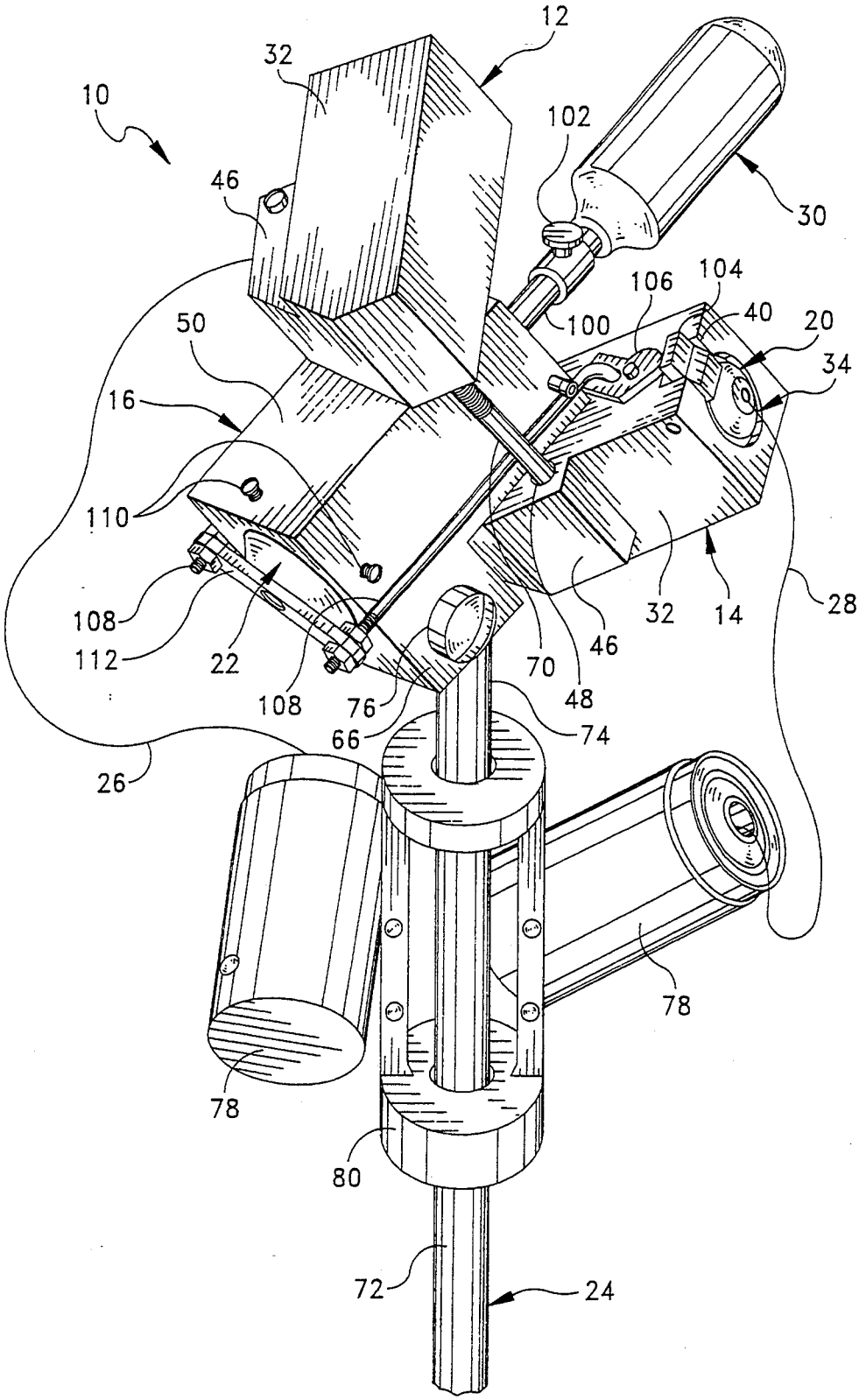
FIG. 1 is perspective view of the orthogonal line deployment device of the instant invention.
Figure 2:
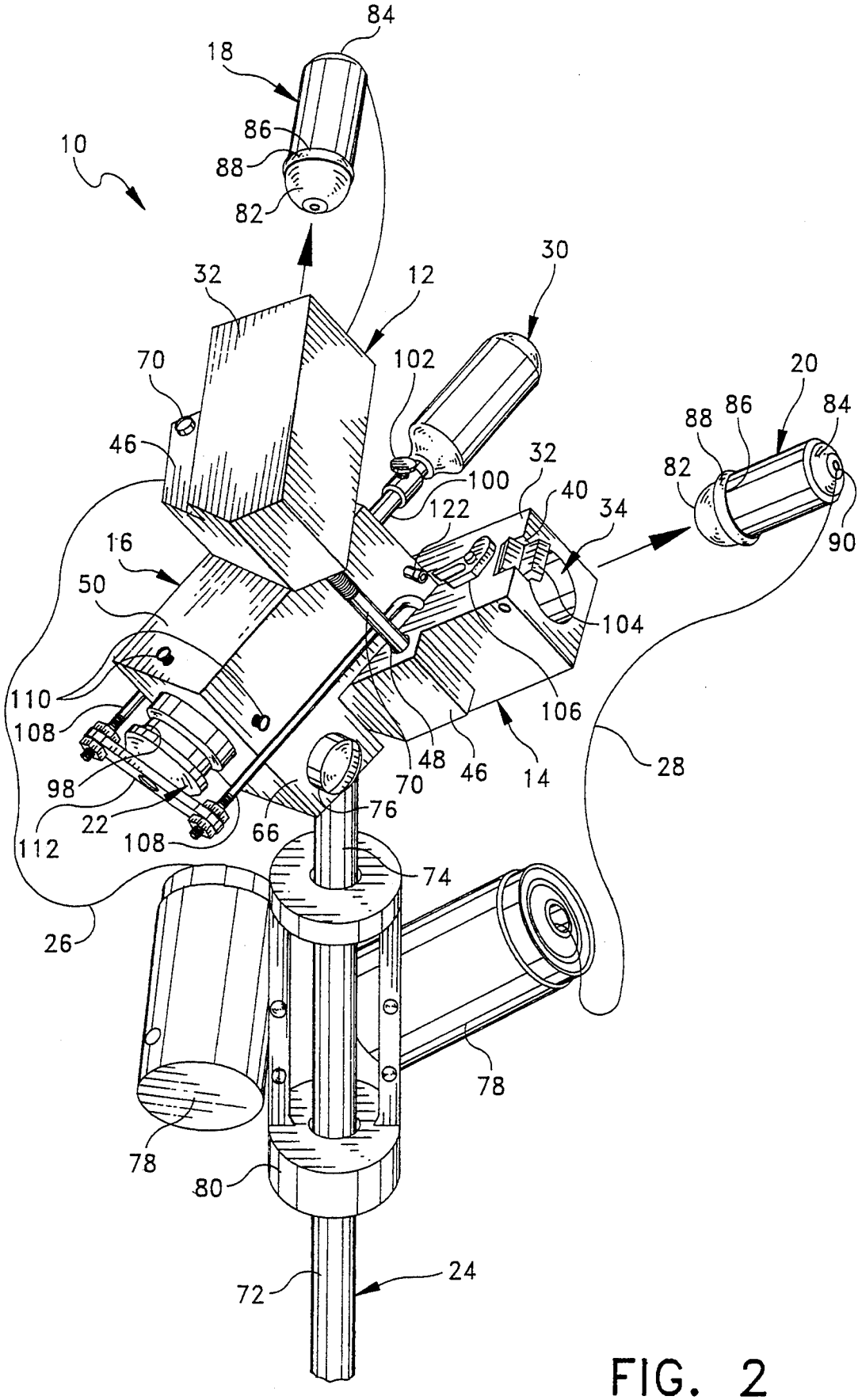
FIG. 2 is a similar view with the wire-carrying projectiles and recoil piston exiting their respective tubes.
Figure 3:
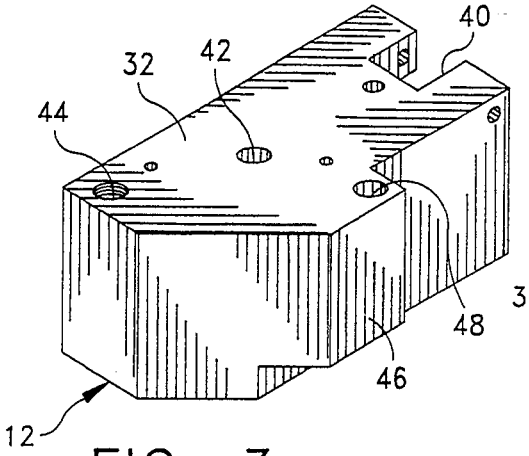
FIG. 3 is a rear perspective view of one of the wire-carrying projectile tubes.
Figure 4:
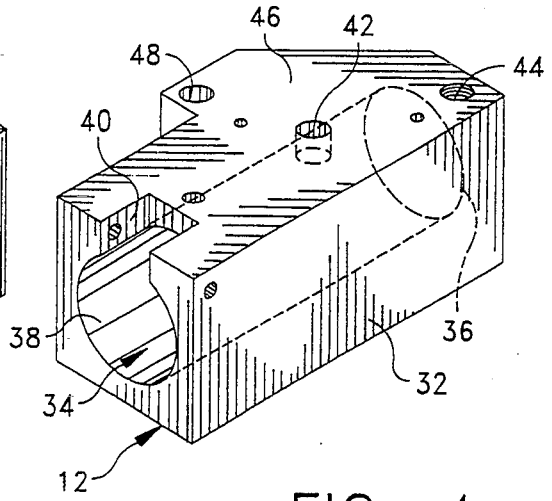
FIG. 4 is a front perspective view thereof.
Figure 5:
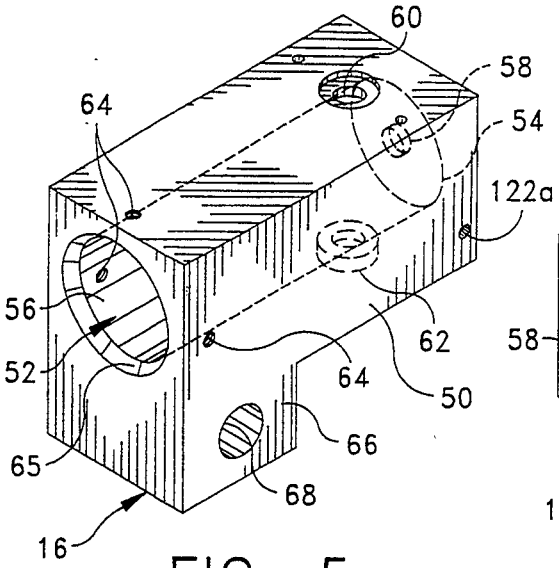
FIG. 5 is a front perspective view of the recoil piston tube.
Figure 6:
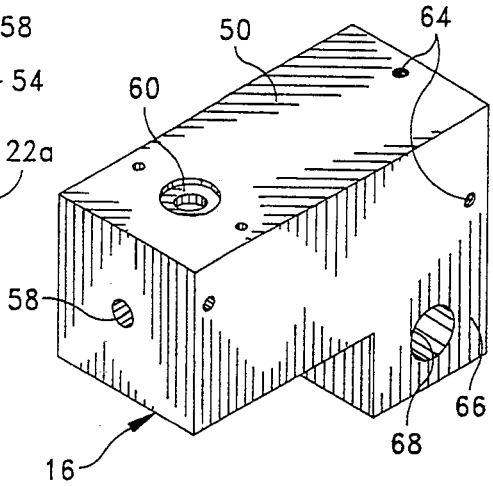
FIG. 6 is a rear perspective view thereof.
Figure 8:
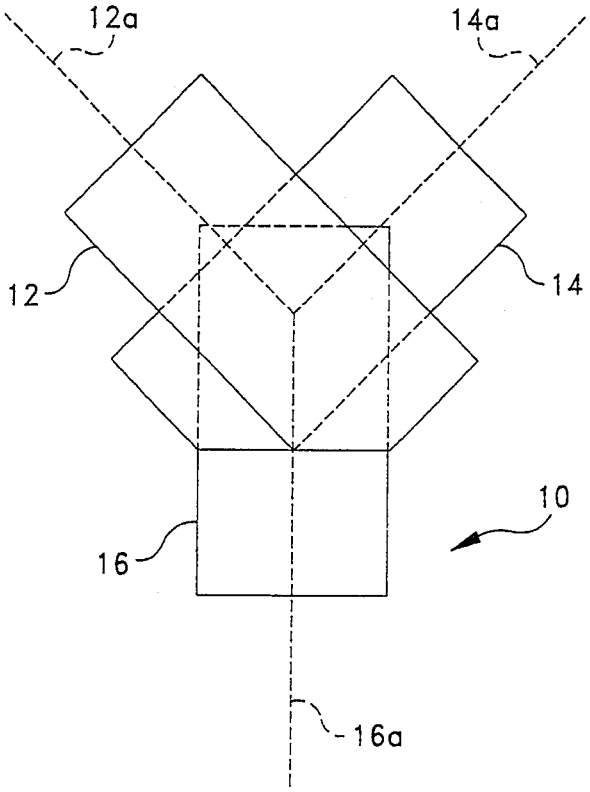
FIG. 8 is a top view of the device showing the axial alignment of the three tubes.

Referring now to the drawing figures, the orthogonal line deployment device of the instant invention is illustrated and generally indicated at 10 in FIGS. 1, 2 and 8. As will hereinafter be more fully described, the instant invention is operable for orthogonally deploying two antenna lines to a distance of more than 100 feet.

The device 10 comprises first, second and third closed ended tubes generally indicated at 12, 14 and 16, first and second wire-carrying projectiles generally indicated at 18 and 20, a recoil piston generally indicated at 22, a vertical mast generally indicated at 24 for supporting the device 10 above a supporting surface, first and second continuous lengths of antenna line 26 and 28, and a pressurized gas cartridge generally indicated at 30.

The first and second tubes 12 and 14 (FIGS. 1–4) each comprise a generally rectangular body portion 32 having a cylindrical bore generally indicated at 34 formed therein having a closed end 36 and an open end 38. The body portion 32 of each tube 12 and 14 further includes a rectangular opening 40 adjacent the open end 38 of the bore 34, a gas vent 42 which extends into the bore 34, and a threaded mounting bore 44 adjacent the closed end 36 of the bore 34. The body portion 32 still further includes a generally rectangular appendage 46 having a mounting hole 48 formed therein. The rectangular opening 40 is operative for mounting retaining means for retaining the projectiles 18 and 20 within the tubes 12 and 14. The gas vent 42 is operable for introducing a flow of pressurized gas into the bore 34.

The third tube 16 (FIGS. 1, 2, 5 and 6) also comprises a generally rectangular body portion 50 having a cylindrical bore generally indicated at 52 formed therein having a closed end 54 and an open end 56. The body portion 50 further includes a gas port 58 at the closed end 54 of the bore 52, two opposing gas vents 60 and 62 respectively, which are positioned on upper and lower sides of the body portion 50, and a plurality of radially extending, threaded apertures 64 adjacent the open end 56 of the bore 52. The gas port 58 permits a flow of pressurized gas into the bore 52, and the radial apertures 64 are operative for threadedly receiving shearable retainer screws therein. The open end 56 of the bore 52 is preferably chamfered as at 65 to facilitate the insertion of the recoil piston 22 therein. The body portion 50 still further includes a rectangular appendage 66 having a mounting hole 68 formed therein.

The three tubes 12, 14 and 16 are assembled together, one stacked on top of another, as illustrated in FIGS. 1 and 2, with the third tube 16 being sandwiched between the first and second tubes 12 and 14. The tubes 12, 14, and 16 are assembled so that the gas vents 42 in the first and second tubes 12 and 14, align and communicate with the gas vents 60 and 62 on the upper and lower sides of the third tube 16. The tubes 12, 14 and 16 are maintained in assembled relation by two opposing mounting bolts 70 which are first extended through the mounting holes 48 in the appendages 46 of the first and second tubes 12 and 14, and then threadedly received in the threaded bores 44 in the opposing body portion 32. (See FIGS. 1 and 2). The first and second tubes 12 and 14 are preferably arranged so that their longitudinal axes 12*a* and 14*a* (See FIG. 8) are perpendicular to each other, and the third tube 16 is arranged so that its respective longitudinal axis 16a lies along a resultant vector of the longitudinal axes 12*a* and 14*a* of the first and second tubes 12 and 14.

The mast 24 comprises a cylindrical, vertically oriented rod 72 having a first end (not shown) which is securable by any conventional means to a supporting surface and a second end 74 which is adapted to be secured to the appendage 66 of the third tube 16 by a threaded fastener 76.

The antenna lines 26 and 28 preferably comprise #6 Litz wire, although other types of wire are also suitable, and they are preferably wound onto spools 78. The spools 78 are formed by winding the line around a tapered mandrel (not shown), and when a sufficient amount of line is wound, the mandrel is removed and the line is allowed to pay out from the center of the spool 78. The taper in the center of the spool 78 helps limit snags when the line is paying out. The spools 78 are mounted onto a carrier 80 which is rotatably mounted to the mast 24 directly below the tubes 12, 14 and 16. In order to keep the lines 26 and 28 paying out freely, the carrier 80 is permitted to freely rotate around the mast 24.

The first and second wire-carrying projectiles 18 and 20 (FIG. 2) each comprise a bullet-shaped slug having a rounded head portion 82, a tail portion 84, and a circumferential groove 86 adjacent to the rounded head portion 82. Each of the wire-carrying projectiles 18 and 20 further includes a resilient O-ring 88 which is received in the circumferential groove 86. The tail portion 84 of the projectiles 18 and 20 each include a fastener 90 for connecting their respective antenna line 26 and 28 thereto. The wire-carrying projectiles 18 and 20 are snugly received within the bores 34 in the first and second tubes 12 and 14 with the head portions 82 adjacent to the closed ends 36 of the bores 34, and the first and second antenna lines 26 and 28 are respectively attached to the fasteners 90 at the tail portions 84 of the projectiles 18 and 20. The resilient O-rings 88 are operative for forming a gas-tight seal between the wire-carrying projectiles 18 and 20 and their respective bores 34.

Figure 7:
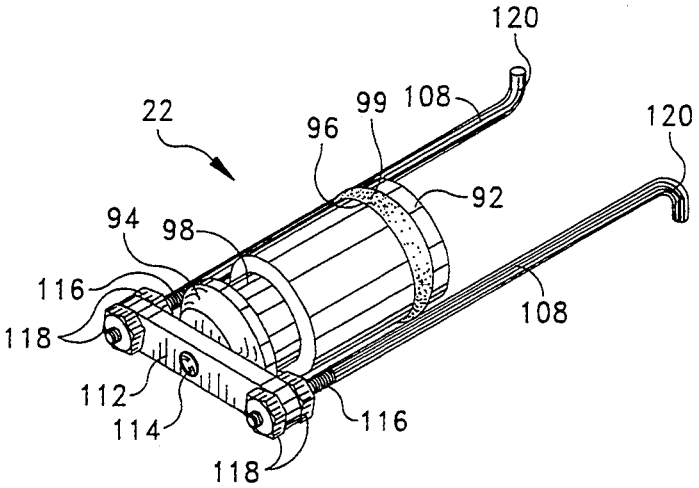
FIG. 7 is a perspective view of the recoil piston.

The recoil piston 22 (FIG. 7) comprises a cylindrical slug having a first end 92, a second end 94, and first and second circumferential grooves 96 and 98 respectively, which are respectively located adjacent the first and second ends 92 and 94. A resilient O-ring 99 is received in the first groove 96. The recoil piston 22 is dimensioned to have a cross-sectional area which is 1.414 times larger than the cross-sectional areas of each of the wire-carrying projectiles 18 and 20. The increased cross-sectional area of the recoil piston 22 is provided to produce an equal and opposite reaction force to the wire-carrying projectiles 18 and 20 along the resulting vector line 16*a* (FIG. 8).

The pressurized gas canister 30 preferably comprises an eight gram carbon dioxide canister and it is connected to the gas port 58 on the body portion 50 of the third tube 16 by a conventional gas conduit 100. The gas canister preferably includes selectively actuatable valve means 102 for selectively permitting the flow of pressurized gas into the tubes 12, 14 and 16. It is pointed out that when the valve means 102 is actuated to permit the flow of pressurized gas into the third tube 16, the gas flows through the third tube 16 into the first and second tubes 12 and 14 via the gas vents 60 and 62, so that all three tubes 12, 14 and 16 are simultaneously and equally pressurized.

Figure 9:
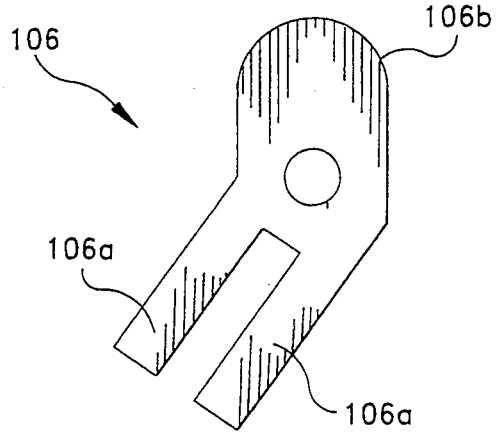
FIG. 9 is a plan view of one of the cams for the retaining mechanism.

The device 10 still further includes a retainer mechanism for retaining the first and second projectiles 18 and 20, and the recoil piston 22 in their respective tubes 12, 14 and 16 until a predetermined, equal gas pressure is attained in each of the tubes. The retainer mechanism is operable for simultaneously releasing the wire-carrying projectiles 18 and 20, and the recoil piston 22 when the predetermined gas pressure is achieved. The retainer mechanism comprises a pair of retainer levers 104 which are pivotably mounted in the rectangular openings 40 at the open ends 38 of each of the first and second tubes 12 and 14, a pair of cams 106 (FIG. 9) which are rotatably mounted adjacent to each of the pivotable levers 104, a pair of actuator rods 108 fixedly attached to the recoil piston 22, and a plurality of shearable retainer screws 110 which are threadedly received in the radial apertures 64 adjacent the open end 56 of the third tube 16. Referring to FIG. 9, each of the cams 106 includes a pair of depending legs 106*a* which slidably receive an actuator rod 108 and a rounded camming head 106*b* which engages a lever 104. It is to be understood that the cam 106 and lever 104 arrangement is identical on both tubes 12 and 14 even though the cam 106 and lever 104 are only visible in connection with the second tube 14. The cams 106 are operable for pivoting the levers 104 between a first position (FIG. 1), wherein the levers 104 are in retaining engagement with the wire-carrying projectiles 18 and 20 in the first and second tubes 12 and 14, and a second position, (FIG. 2), wherein the levers 104 are pivoted out of engagement with the wire-carrying projectiles 18 and 20 so as to release same for ejection. The actuator rods 108 are attached to the recoil piston 22 by a bar-shaped yoke 112 which is fixedly attached to the recoil piston 22 by a rivet 114 or other suitable connector. The actuator rods 108 each have a first threaded end 116 which is attached by threaded nuts 118 to the yoke 112 so that the rods 108 extend parallel to the piston 22, and a second hooked end 120. The rods 108 are rotatably aligned in the yoke 112 so that the hooked ends 120 extend outwardly in opposite directions. (See FIG. 7).

The recoil piston 22 is snugly received within the bore 52 of the third tube 16, as illustrated in FIGS. 1 and 2, with the actuator rods 108 extending along the outside of the body portion 50. The resilient O-ring 99 is operative for forming a gas-tight seal between the recoil piston 22 and the bore 52. When the recoil piston 22 is fully inserted into the bore 52 (FIG. 1), the actuator rods 108 engage the cams 106, i.e. the hooked ends 120 are received between the depending legs 106*a* of the cams 106 to rotate the rounded heads 106*b* of the cams 106 into engagement with the levers 104 and thereby pivot the levers 104 into retaining engagement with the wire-carrying projectiles 18 and 20. The body 50 of the third tube 16 is provided with two guide pins 122 (only one shown) which guide the actuator rods 108 along the sides of the body portion 50 and into engagement with the cams 106. The guide pins 122 are received in bores 122*a* (FIG. 5) formed in the sides of the third tube 16.

The shearable retainer screws 110 preferably comprise nylon screws and they are threadedly received in the radial apertures 64 adjacent the open end 56 of the third tube 16 so that they extend into the second circumferential groove 98 in the recoil piston 22. In this regard, the nylon screws 110 are operative for retaining the recoil piston 22 within the third tube 16 while a volume of pressurized gas is being introduced into the bore 52.

To operate the instant deployment device 10, the valve means 102 is actuated to permit a pressurized flow of carbon dioxide gas to flow from the canister 30 into the third tube 16. The pressurized gas flows through the third tube 16 to the first and second tubes 12 and 14 via the gas vents 60 and 62 to simultaneously and equally pressurize all three tubes 12, 14 and 16. The pressurized gas builds up pressure within the three tubes 12, 14 and 16 to create a propulsion force which is sufficient for shearing the nylon retainer screws 110 and propelling the recoil piston 22 and the wire-carrying projectiles 18 and 20 outwardly of their respective tubes 12, 14 and 16. In the instant embodiment, the diameter and quantity of retainer screws 110 is selected so that a propulsion force sufficient to propel the wire-carrying projectiles 18 and 20 at least one hundred feet is achieved. However, the distance travelled by the wire-carrying projectiles 18 and 20 can be altered by increasing or decreasing the diameter and/or the quantity of retainer screws 110 so that a greater or lesser gas pressure is required to shear the screws 110. When the nylon retainer screws 110 shear, the recoil piston 22 moves slightly outwardly drawing the actuator rods 108 out of engagement with the cams 106 which in turn rotate and release the retainer levers 104. The pressurized gas in the first and second tubes 12 and 14 simultaneously ejects the wire-carrying projectiles 18 and 20 outwardly of their tubes, pivoting the now-free retainer levers 104 out of the way. It can thus be appreciated that the wire-carrying projectiles 18 and 20 and the recoil piston 22 are simultaneously propelled outwardly and that the recoil piston 22 produces an equal and opposite reaction force to the first and second wire-carrying projec-tiles 18 and 20 so that the device 10 produces substantially no recoil when the projectiles 18 and 20 are released. When the wire-carrying projectiles 18 and 20 are launched, the antenna lines 26 and 28, respectively, attached thereto operate to reorient the projectiles 18 and 20 so that the rounded head portion 82 faces forwardly for travel through the air. As the projectiles 18 and 20 travel through the air, the lines 26 and 28 pay out from the spools 78 to provide two orthogonal antenna lines.

It can therefore be seen that the instant invention provides an effective line deployment device 10 which is operative for orthogonally deploying two antenna wires 26 and 28 to a distance of over one hundred feet. The device 10 utilizes a single pressurized gas cartridge 30 to pressurize three launching tubes 12, 14 and 16, so that all the tubes 12, 14 and 16 are simultaneously and equally pressurized. The tubes 12 and 14 housing the wire-carrying projectiles 18 and 20 are arranged perpendicular to each other and the third tube 16 is arranged along the resulting vector of the axes of the first and second tubes 12 and 14. In this manner, the recoil piston 22 produces an equal and opposite reaction force to the wire-carrying projectiles 18 and 20 so that the device is essentially recoilless.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A line deployment device for simultaneously deploying two lines comprising:

first, second and third tubes each having a closed end, an open end and a longitudinal axis, said first and second tubes being arranged so that said respective longitudinal axes are angled with respect to each other, said third tube being arranged so that said respective longitudinal axis lies along a resultant vector of the longitudinal axes of said first and second tubes;

first and second projectiles respectively slidably received in said first and second tubes;

a recoil piston slidably received in said third tube, said recoil piston having a larger cross-sectional area than said first and second projectiles;

means for forming a gas tight seal between said projectiles and said respective tubes, and between said piston and said third tube;

first and second continuous lengths of line respectively attached to said first and second projectiles;

means for selectively simultaneously introducing a pressurized flow of gas into said first, second and third tubes;

means for retaining said first and second projectiles and said piston in said respective tubes until a predetermined equal gas pressure is achieved within each of said tubes; and said retaining means automatically and simultaneously releasing said first and second projectiles and said recoil piston at said predetermined gas pressure, wherein said gas pressure is operable for propelling said first and second projectiles outwardly of said respective tubes, said first and second lengths of line being deployed as said first and second projectiles travel through the air, and said recoil piston producing an equal and opposite force to said first and second projectiles so that said device produces substantially no recoil.

2. In the device of claim 1 said recoil piston having a cross-sectional area approximately 1.4 times larger than said first and second projectiles.

3. In the device of claim 1 said recoil piston having a cross sectional area 1.414 times larger than said first and second projectiles.

4. In the device of claim 1 said means for retaining comprising:

pivotable lever means mounted at the open end of each of said first and second tubes for retaining said first and second projectiles within said first and second tubes;

means coupled to said recoil piston for pivoting said lever means into engagement with said first and second projectiles;

a circumferential groove in said recoil piston;

a plurality of radial apertures adjacent the open end of said third tube;

a plurality of shearable retainer elements received in said apertures so as to engage with said groove in said recoil piston; and said retainer elements shearing at said predetermined gas pressure to release said recoil piston from said third tube wherein movement of said recoil piston causes said means for pivoting to release said lever means thereby simultaneously releasing said first and second projectiles.

5. In the device of claim 4 said means for pivoting comprising:

cam means rotatably mounted adjacent the open end of each of said first and second launch tubes for pivoting said lever means into engagement with said projectiles;

actuator means attached to said recoil piston for rotating said cam means into and out of engagement with said lever means; and wherein movement of said recoil piston causes said actuator means to release said cam means, said cam means to release said lever means, and said lever means to release said first and second projectiles.

6. In the device of claim 5 said actuator means comprising rod means fixedly attached to said recoil piston.

7. In the device of claim 1 said first, second and third tubes being stacked one on top of another, said means for selectively simultaneously introducing a pressurized flow of gas into said first, second and third tubes comprising:

a gas port in the closed end of said third tube;

means for venting said third tube into said first and second tubes so as to provide a singular gas chamber;

a pressurized gas canister connected to said gas port; and selectively actuable valve means for selectively introducing said flow of pressurized gas into said gas chamber.

8. In the device of claim 1 said means for forming a gas tight seal comprising:

a circumferential groove in each of said first and second projectile and in said recoil piston, and a resilient O-ring received in each of said circumferential grooves.

9. In the device of claim 1 said first and second tubes being arranged perpendicular to each other, said first and second continuous lengths of line being simultaneously orthogonally deployed.

10. In the device of claim 1 said first and second tubes being arranged perpendicular to each other wherein said first and second lengths of line are simultaneously orthogonally deployed.

11. A line deployment device for simultaneously deploying two lines comprising:

first and second tubes each having a closed end, an open end and a longitudinal axis, said first and second tubes being arranged so that said respective longitudinal axes are angled with respect to each other;

first and second projectiles respectively slidably received in said first and second tubes;

means for forming a gas tight seal between said first and second projectiles and said respective tubes;

first and second continuous lengths of line respectively attached to said first and second projectiles;

means for selectively simultaneously introducing a pressurized flow of gas into said first and second tubes;

means for retaining said first and second projectiles in said respective tubes until a predetermined gas pressure is achieved within said respective tubes; and said retaining means simultaneously releasing said first and second projectiles at said predetermined gas pressure wherein said gas pressure is operative for propelling said first and second projectiles outwardly of said tubes, said first and second lengths of line being simultaneously deployed as said first and second projectiles travel through the air.

12. In the device of claim 11 said means for forming a gas tight seal comprising:

a circumferential groove in each of said projectiles and a resilient O-ring received in each of said grooves.

* * * * *